US005615872A

United States Patent [19]

Mochimaru

[11] Patent Number: 5,615,872

[45] Date of Patent: Apr. 1, 1997

[54] DETACHABLE DUPLEX COPYING UNIT FOR AN IMAGE FORMING APPARATUS

[75] Inventor: Hideaki Mochimaru, Atsugi, Japan

[73] Assignee: Ricoh Company, Ltd., Tokyo, Japan

[21] Appl. No.: 344,644

[22] Filed: Nov. 18, 1994

[30] Foreign Application Priority Data

Nov. 18, 1993 [JP] Japan ..... 5-288888

[51] Int. Cl.[6] ..... B65H 5/22

[52] U.S. Cl. ..... 271/3.14; 271/3.19; 271/3.2; 271/65; 271/301

[58] Field of Search ..... 271/301, 65, 186, 271/3.2, 3.19, 3.14; 355/319, 318; 346/107.6, 134; 347/104

[56] References Cited

U.S. PATENT DOCUMENTS

| | | | |
|---|---|---|---|
| 4,605,299 | 8/1986 | Mochimaru . | |
| 4,757,344 | 7/1988 | Idenawa et al. . | |
| 4,875,063 | 10/1989 | Idenawa et al. . | |
| 4,954,848 | 9/1990 | Arima | 355/319 |
| 4,956,678 | 9/1990 | Kiya et al. | 271/186 X |
| 5,083,170 | 1/1992 | Sawada et al. | 355/319 |
| 5,257,068 | 10/1993 | Sawada et al. | 355/200 |
| 5,337,134 | 8/1994 | Sato et al. | 271/186 X |

FOREIGN PATENT DOCUMENTS

| | | | |
|---|---|---|---|
| 6-191685 | 7/1994 | Japan | 271/301 |

*Primary Examiner*—David H. Bollinger
*Attorney, Agent, or Firm*—Oblon, Spivak, McClelland, Maier & Neustadt, P.C.

[57] ABSTRACT

An operation/display panel is attached to an outer surface in front of a printer body, and a duplex unit is detachably attached between the operation panel and the outer surface of the printer body. The duplex unit functions to return the copy paper ejected from an ejecting outlet and having an image on one side thereof toward a paper feeding inlet of the printer body to provide two-sided copying/printing. The operation panel includes operating switches and/or a display, and is slidably mounted such that a space is provided between the operation panel and the printer body, and the duplex unit can then be inserted into the space when two-sided printing/copy is desired.

19 Claims, 8 Drawing Sheets

DETACHABLE DUPLEX COPYING UNIT FOR AN IMAGE FORMING APPARATUS

BACKGROUND OF THE INVENTION

1. Field of the Invention

The present invention relates to improvements in duplex copying units, which can be optionally and detachably mounted upon an image forming apparatus, for example, a copier, facsimile machine, printer, etc.

2. Description of the Related Prior Art

In a conventional image forming apparatus, a duplex copying unit can be optionally attached/detached thereto, since a user does not always need the duplex copying function. The duplex copying unit receives a sheet having an image or printing on one side thereof, and returns the sheet to the inlet of the image forming apparatus, so that two-sided printing or copying can be achieved. In the case where the duplex unit is utilized it is detachably mounted upon the image forming apparatus. However, problems can arise with regard to which part or location at which the duplex unit should be attached. In particular, in the conventional image forming apparatus, there is provided an operation key, by which a predetermined copy mode is set, and/or an operation board, on which, for example, a copying number is displayed, at a front side of the body of the image forming apparatus. In such device, if a duplex copying unit is attached over the operation key and/or an operation board, it is difficult for the operator to view or have access to the operation key and/or an operation/display board.

One conventional image forming apparatus, for example, as disclosed in the specification of the Japanese Laid Open Patent Publication Number 60-209745/1985, resolves the above problems. If a duplex copying unit is attached to the image forming apparatus covering the operation key and/or a operation board, it is moved to a position where the operator can see it more easily. However, in such a device the it is still difficult for the operator to see the operation panel from a place remote therefrom, for example, from a host-computer to which the above-mentioned image forming device is connected.

SUMMARY OF THE INVENTION

The present invention avoids the above problems. According to the present invention, an operation panel is attached on an outer surface and in front of the printer board, and is slidably movable with respect to the printer body. A duplex unit is detachably attached between the operation panel, and an outer surface of the printer body. As a result the duplex unit can function to feed back the copy paper ejected from the ejecting outlet toward a paper feeding inlet of the printer body, without obstructing an operation or display panel.

BRIEF DESCRIPTION OF THE DRAWINGS

A more complete appreciation of the invention and many of the attendant advantages thereof will be readily obtained as the same becomes better understood by reference to the following detailed description, particularly when considered in conjunction with the accompanying drawings, wherein.

DETAILED DESCRIPTION OF THE PREFERRED EMBODIMENT

Figure 2:
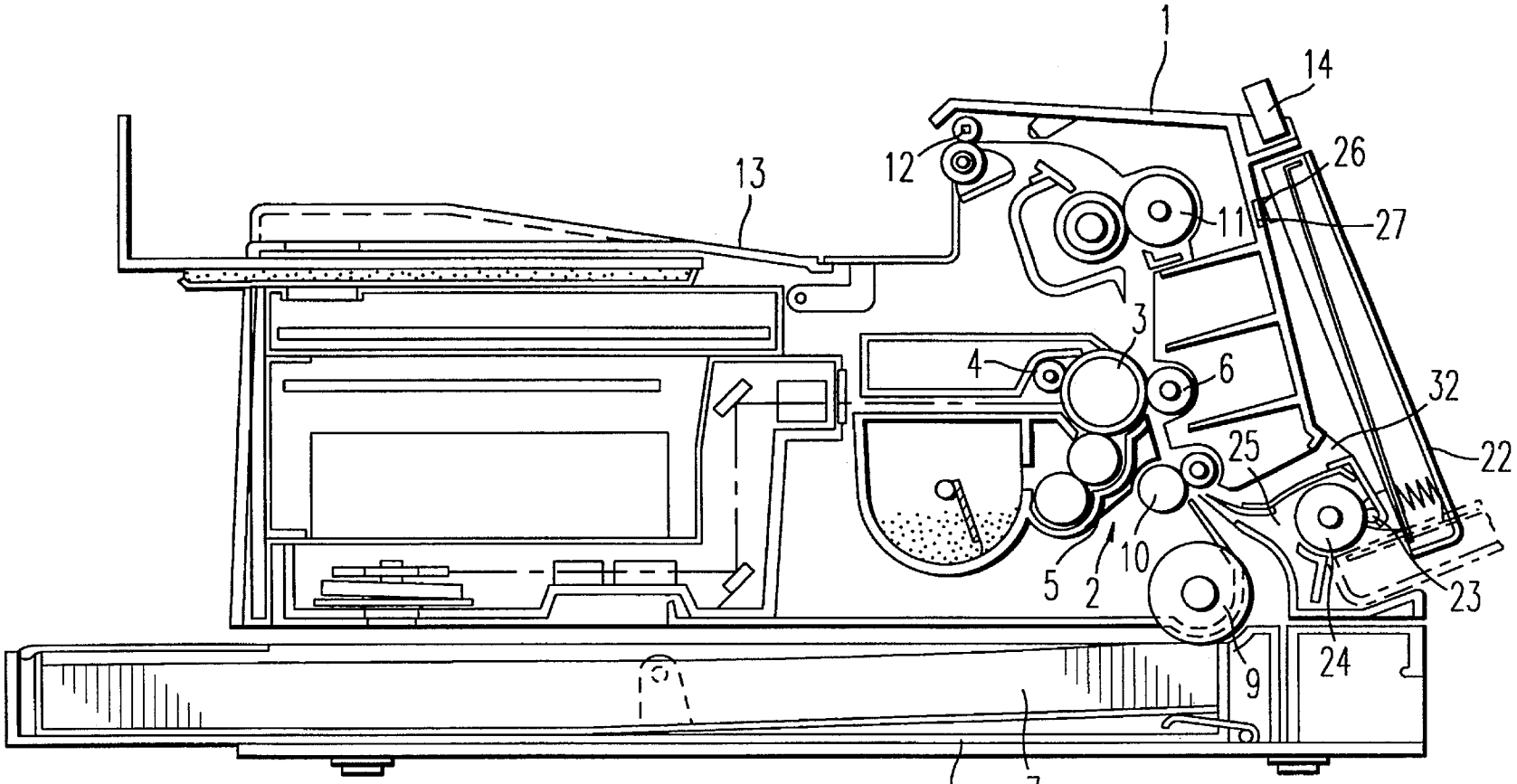
FIG. 2 is a sectional view of the image forming apparatus which does not have the duplex copying unit attached thereto.

Referring now to the drawings, wherein like reference numerals designate identical or corresponding parts throughout the several views, as shown in FIG. 2, an image forming apparatus, for example, a laser printer, copier etc., includes image forming parts 2 disposed approximately at a center of a body casing 1, and can include a photo-sensitive drum 3, a discharging device 4, a developing device 5, a transferring device 6 and additional conventional elements. Below the image forming parts 2, a paper cassette accommodating copy paper 7, a feeding roller 9 for feeding the paper one by one, and a resisting roller 10 are disposed. Further, a fixing device 11 for fixing an image transferred to the paper by the transferring device 6, and an ejecting portion 12 for ejecting the copy paper 7 having the image thereon are disposed over the image forming parts 2. In addition, an ejecting tray for receiving a copy paper ejected through the ejecting portion 12 is disposed on the body casing 1.

Figure 1:
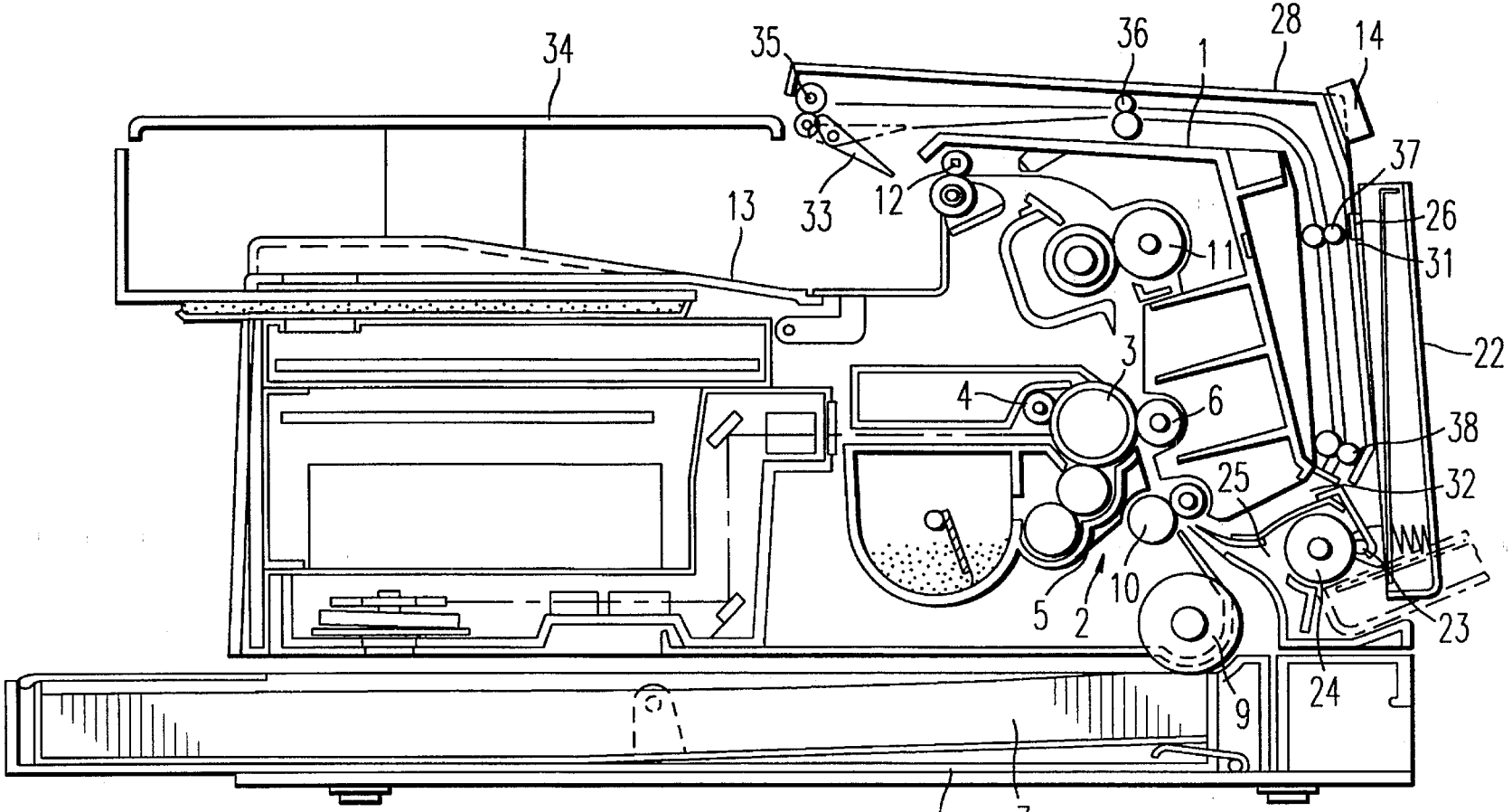
FIG. 1 is a sectional view of the image forming apparatus of the present invention, to which a duplex copying unit is attached.
Figure 3:
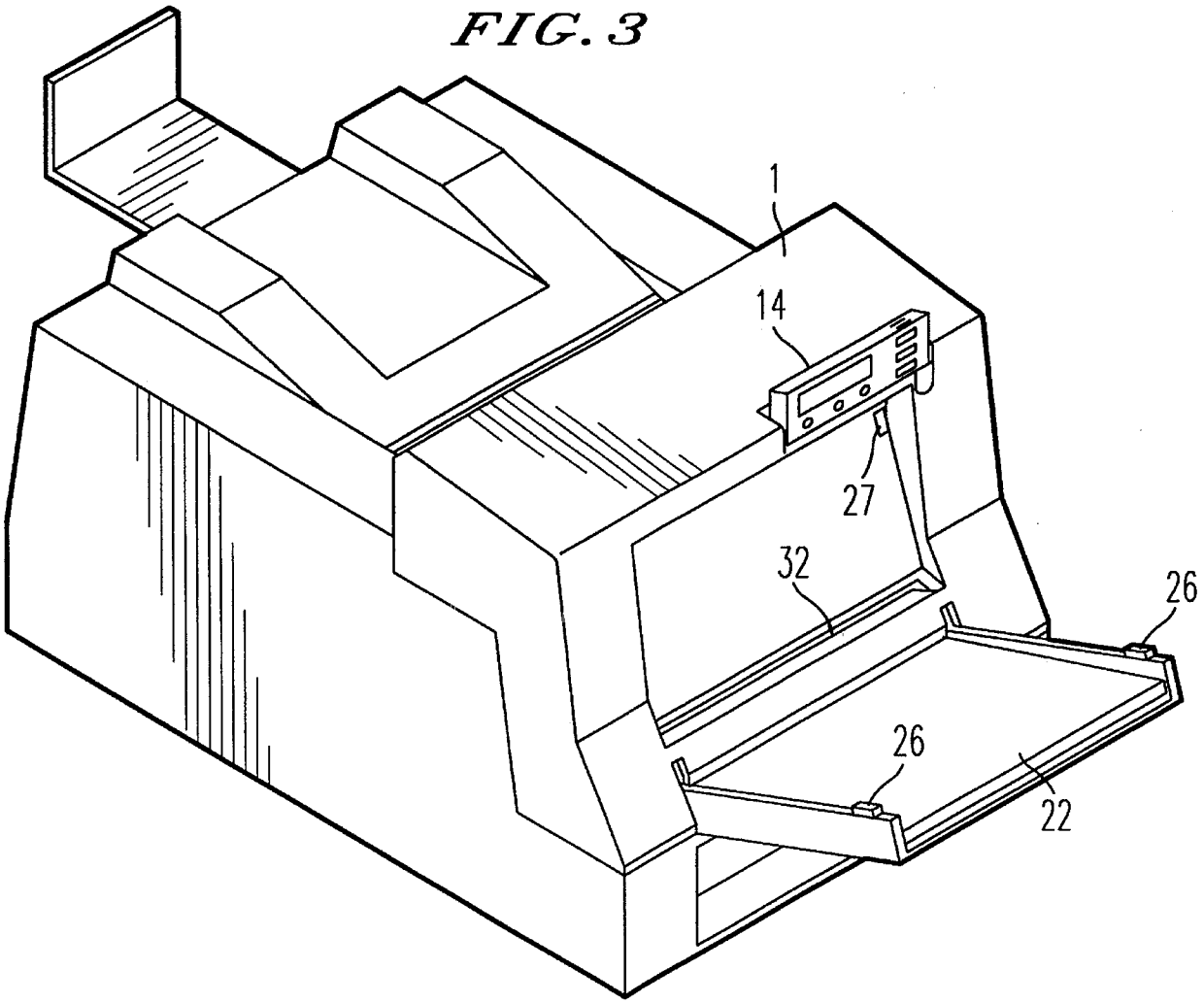
FIG. 3 is a perspective view of the image forming apparatus without the duplex copying unit.
Figure 5:
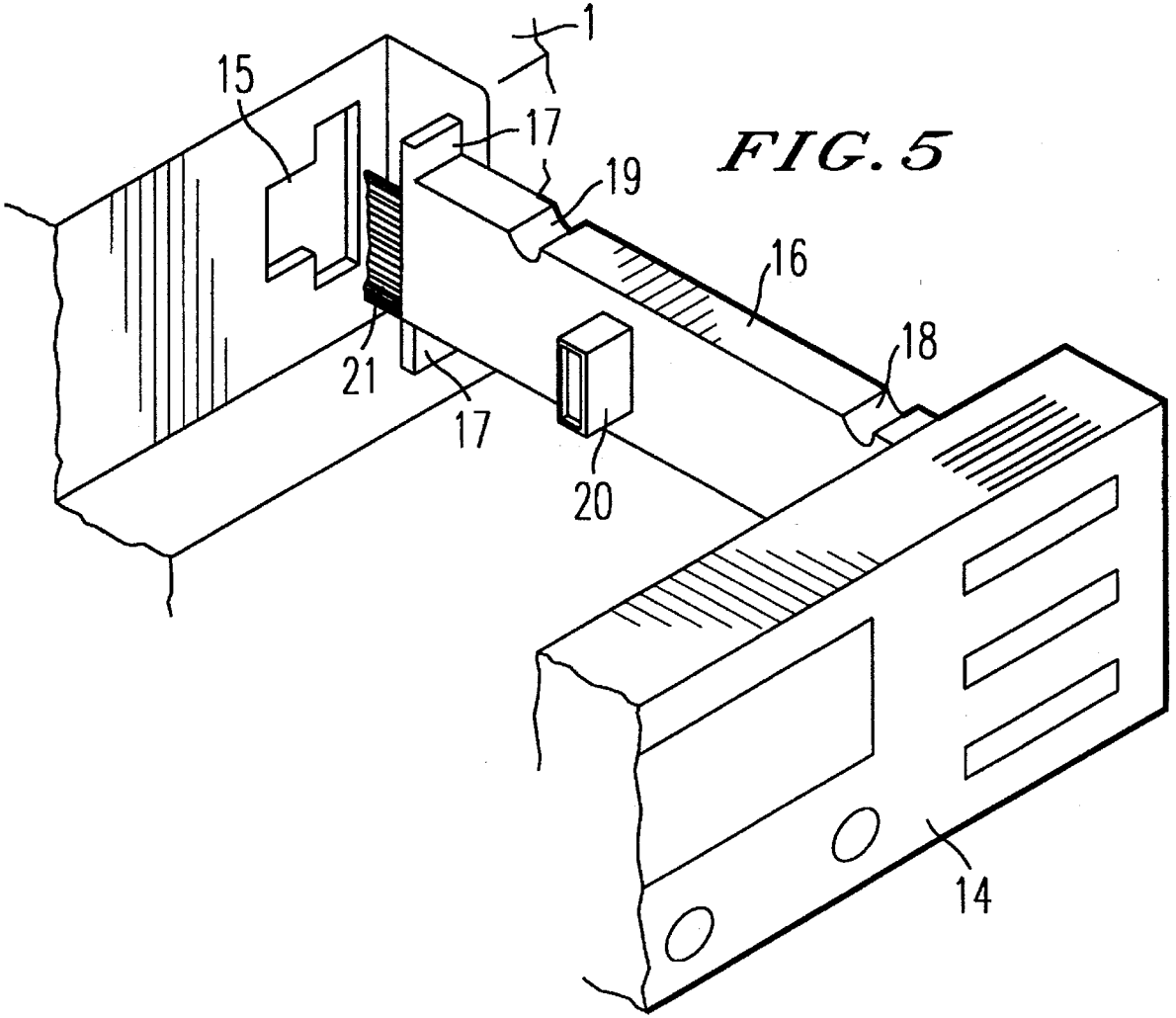
FIG. 5 is a perspective view depicting mounting of the operation panel onto the image forming apparatus.

As shown in the FIGS. 1, 2 and 3, an operating panel 14 composed of a plurality of operation keys and a display are disposed at an upper part of the front side of the body casing. As shown in FIG. 5, the operating panel 14 is fixed to a bracket 16 slidably mounted on an opening at an outer surface of the front side of the body casing 1. At an opposite side edge of the bracket 16, a stopper 17 is provided for avoiding removal or limiting movement of the bracket 16 (the stopper 17 is shown outside of the aperture for illustrative purposes). Further, a first recess 18 and a second recess 19 are provided on the bracket 16 so that the fist recess 18 stops/positions the bracket 16 at a position nearer to the side surface of the body casing 1 and the second recess 19 stops the bracket 16 at a position further extended from the surface of the body casing 1. In addition, stoppers are provided in the inner part of the body casing 1 (not shown in the figures) which engage with the recesses 18, 19. The bracket 16 is further provided with a connector 20 thereon for electrically connecting a duplex unit explained later in detail and an electric cable 21 for connecting both the connector 20 and the operating keys on the operating panel 14 to a controller (not shown in the figures) in the body casing 1.

As shown in FIG. 2, a paper feeding tray 22 is provided at a lower part of the body casing 1. The paper feeding tray 22 is pivotally mounted on the body casing 1 about a pin 23 so that the tray can be horizontally positioned during operation of the printer, and vertically positioned when the printer is not operating. A paper feeding roller 24 for feeding the paper 7 accommodated in the paper feeding tray 22 one by one, and a feeding inlet 25 accepting the paper 7 fed by the paper feeding roller 24 are disposed at a lower portion of the body casing 1. In addition, a metal plate 26 is provided on the paper feeding tray 22, and a magnet 27 is provided on the surface of the body casing 1. With this arrangement, the conventional paper feeding tray 22 is connected magnetically with the surface of the body casing 1 when the paper feeding tray 22 is vertically positioned during rest of the printer.

As shown in FIG. 1, the duplex unit 28 is detachably disposed against the body casing 1. A switching gate is provided in the unit adjacent to the outlet of the body casing 1, and a feeding path extends from a location adjacent to the outlet of the body casing 1 to a location adjacent to the inlet of the body casing 1 to feed paper having an image on one side thereof. In the duplex unit 28, the feeding path is generally rectangular. The generally rectangular duplex unit has an L-shape when viewed from the side, and is set on one of the corners of the body casing 1.

Figure 4:
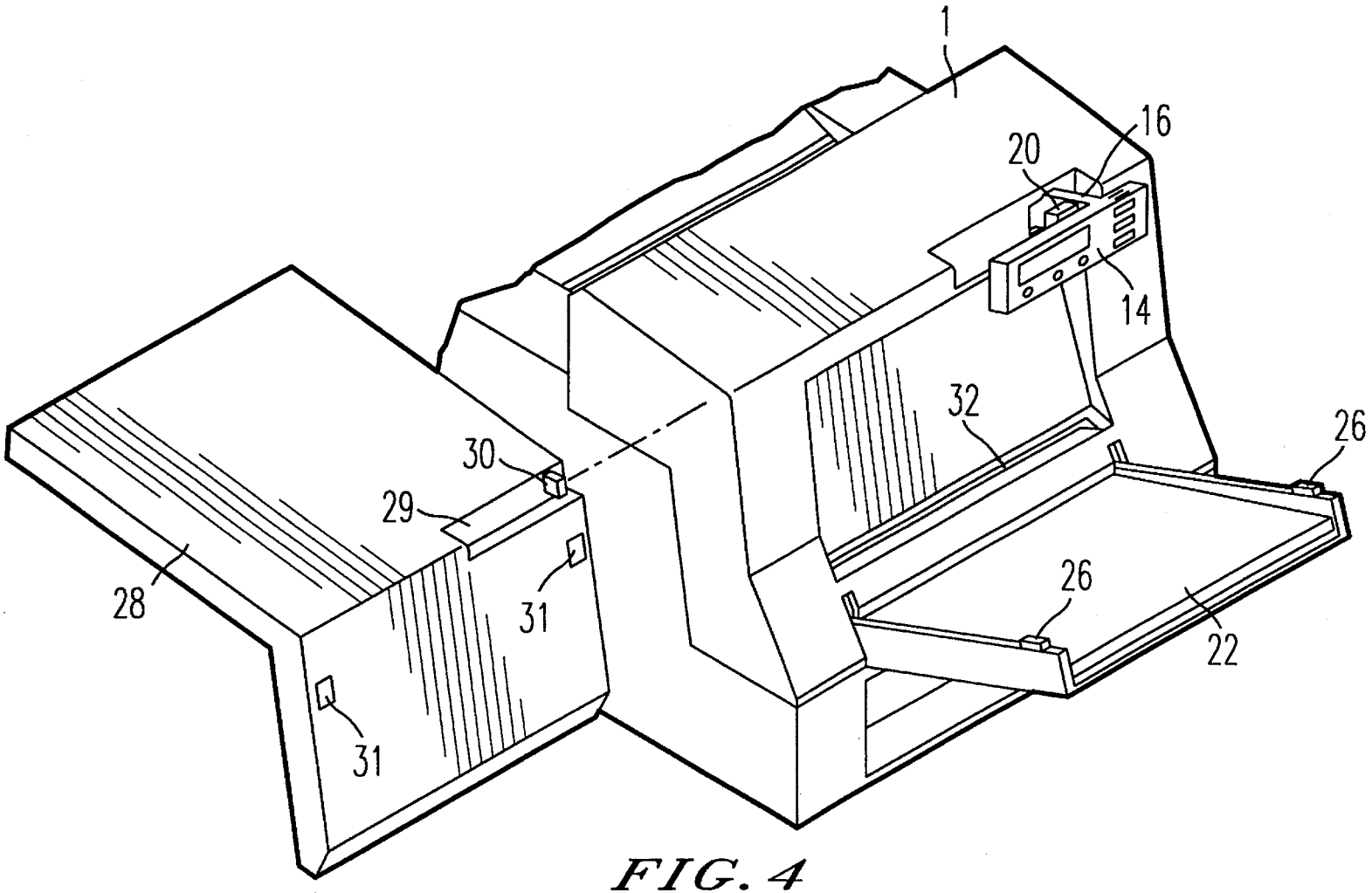
FIG. 4 is a perspective view depicting the way the duplex copying unit is set onto the image forming apparatus.

With the operation panel 14 mounted at a front side of the body casing 1, the operating panel 14 is spaced from the surface of the body casing 1 and the paper feeding tray 22 is positioned vertically. With this arrangement, a space for setting of the duplex unit 28 is provided so that the duplex unit 28 is inserted from left side of the body casing 1 as shown in FIG. 4. On the duplex unit 28, a cut-away portion 29 is formed at the portion corresponding to the operation panel 14, and a counterpart 30 of the connector 20 is provided in the cut portion 29 to connect the connecter 20 with a counterpart thereof. In addition, there is also provided a magnet 31 on a portion of the duplex unit 28 for holding the metal plate 26 disposed on the paper feeding tray 22 when it is in the vertical position. An opening 32, through which the paper fed by the duplex unit 28 enters into the body casing 1, is formed above the paper feeding inlet 25 at the front side of the body casing. Thus, the unit is set onto one of the corners of the body casing as shown in FIG. 4, and can return sheets back to the body for two-sided copying or printing.

In the above-mentioned system, when a duplex copying operation is executed, a switching gate 33 changes position to that shown by the solid line in FIG. 1. The paper 7 having the fixed toner image on one side thereof is then ejected by a reversible ejecting roller 35 through the paper outlet 12. Then the switching gate 33 positioned at the position shown by the solid line in FIG. 1 guides the paper 7 onto a guide 34 tentatively. The paper 7 ejected on the guide 34 is fed and reversed by the ejecting roller 35 when it rotates reversely into the duplex unit 28. After that, the paper 7 is further fed by pairs of the rollers 36, 37, 38, so that the paper 7 enters the body casing 1 to provide a toner image on the other side thereof at the image forming part. Thus, a duplex or double-sided copy is made and the paper 7 having the duplex copy is finally ejected to an ejecting tray 13 from the outlet 12 via the switching gate with the gate positioned at the position shown by the dotted line in FIG. 1.

As discussed above, when a duplex unit 28 is set onto the body casing 1, the operating panel 14 is spaced from the surface of the body casing 1, and the paper feeding tray 22 is positioned vertically from the horizontal plane, and a space for setting of the duplex unit 28 is provided, and the duplex unit 28 is inserted from left side of the body casing 1 as shown in FIG. 4. In particular, prior to inserting the duplex unit, the panel 14 (which can include operating switches and/or a display) is slid out from the body casing 1, with the panel 14 maintained coupled to the body casing 1 via the bracket 16 and stop 17. Therefore, the operational panel 14 can be seen by the operator even though the duplex unit 28 is set on the front surface of the body casing 1, as is the case when the duplex unit is not mounted thereon. This means that if the operation panel 14 is disposed within a width of the paper 7 transferred in the body casing 1, no problem may occur. In addition, the operational panel 14 can be designed to be relatively large so that touching (e.g. for actuating buttons or control switches) thereof and viewing thereof from a distance is easily accomplished. In addition, another connector is not needed when the duplex unit is applied, since the operation panel 14 is spaced from the body casing 1 but not extracted entirely therefrom. Further, additional lengths of electric cable 21 are not needed, and shielding of any magnetic effects of the electric cable 21 can be minimized. Further, with respect to the duplex unit 28, a feeding path therein can be minimized because of the arrangement of the opening 32 which is arranged above the feeding tray 25. Thus, the duplex unit 28 can be made more compact and can be conveniently coupled to the image forming apparatus via the connector 20 (FIG. 5).

Figure 6:
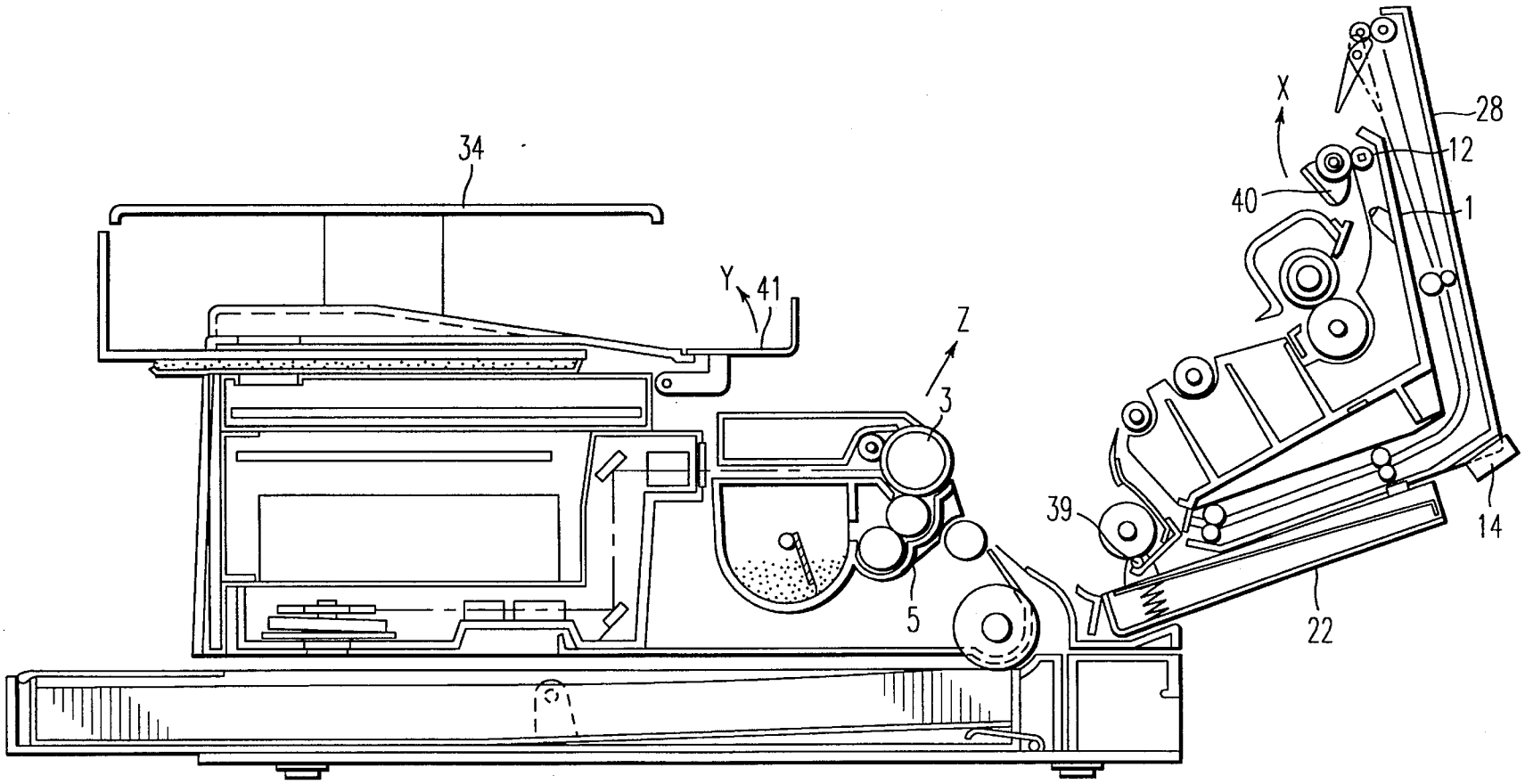
FIG. 6 is a sectional view of the image forming apparatus showing the state in which a front unit is opened.

The manner of removing the jammed paper both in the body casing 1 and in the duplex unit 28 will now be explained. As shown in FIG. 6, the printer body casing 1 can be divided into two units. Namely, a front side unit is opened around the pin 23, which is the center of rotation of the feeding tray 22. Therefore, when a jam occurs in the body casing 1 a front side unit is opened around the pin 23 with the duplex unit 28 attached thereto. Removal of the jammed paper is thereby easily accomplished. Further, removal of jammed paper occurring at the ejecting part 12 is also completed easily, by turning the guide 40 in a direction shown by the arrow x in the figure. In the case an image forming magazine composed of the photo-sensitive drum 3 and/or the developing device 5 is exchanged with a fresh one, a small cover 41 is opened in a direction as shown by the arrow y and the component to be replaced is extracted therefrom.

Figure 7:
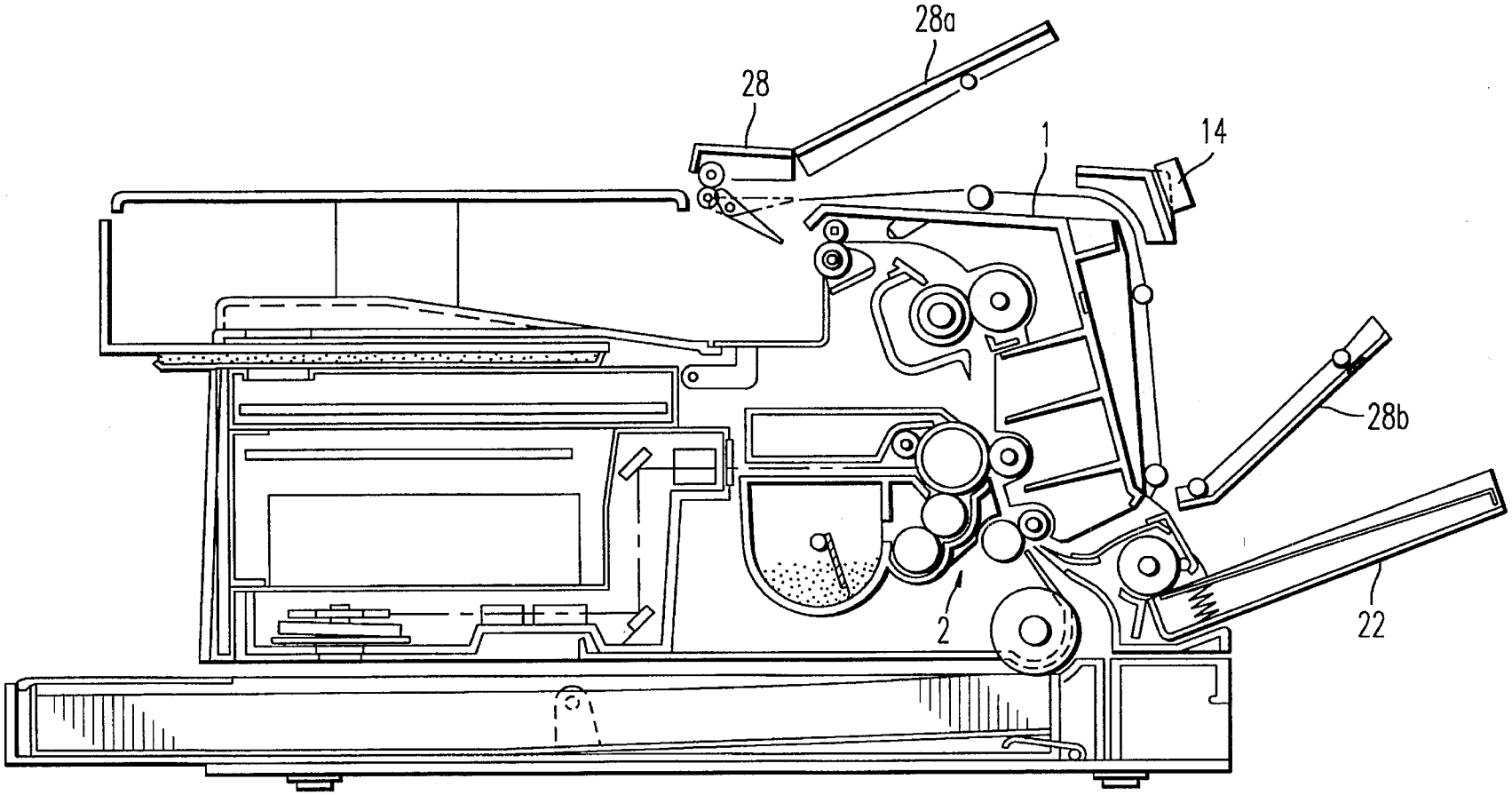
FIGS. 7 and 8 are sectional views of the image forming apparatus showing the state in which covers of the duplex unit are opened.
Figure 8:
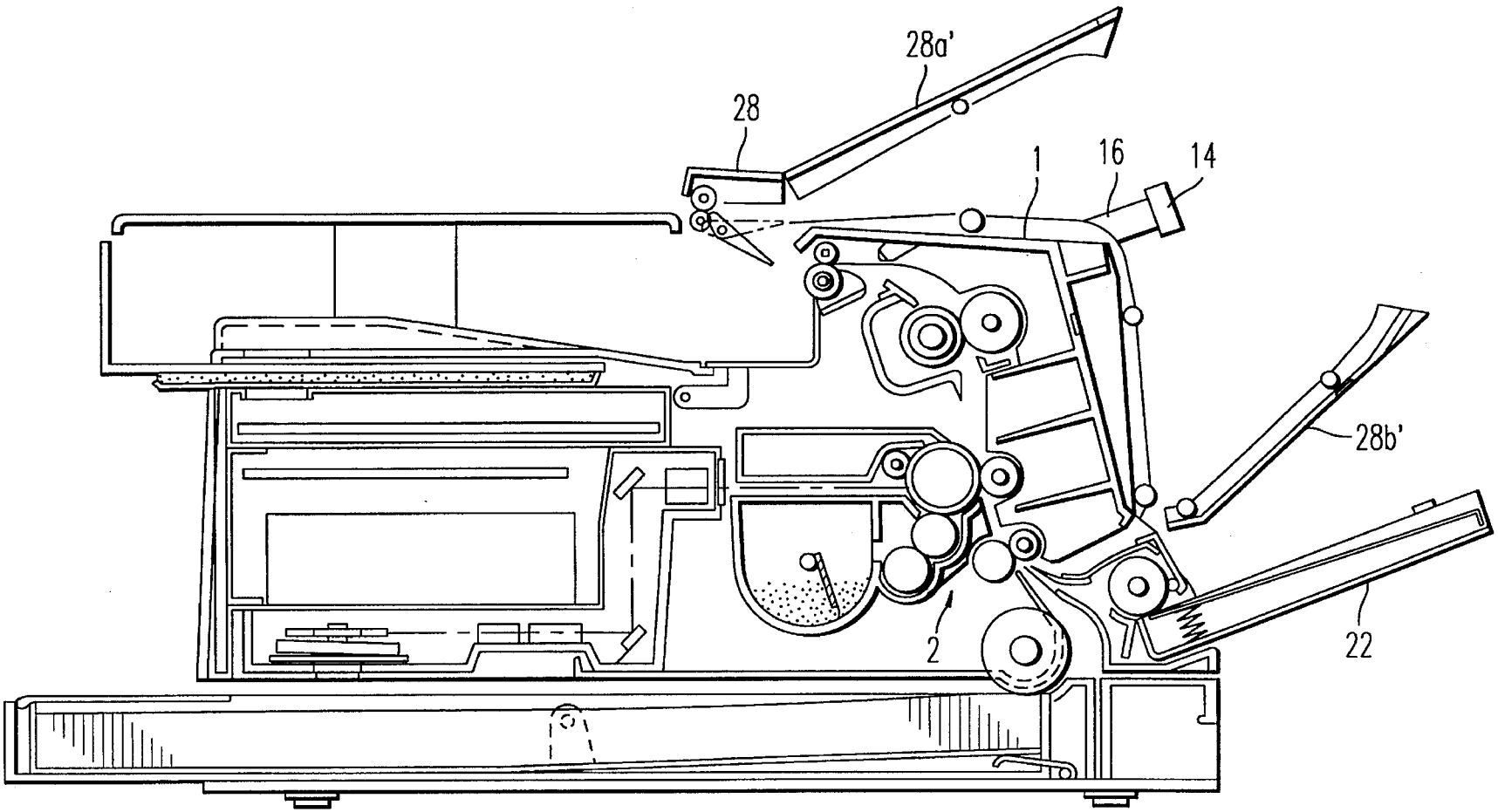

Now, removal of jammed paper in the duplex unit 28 will be explained. As shown in FIG. 7, the duplex unit 28 is opened by opening outer covers **28*a* and 28*b*, each of which is pivotally mounted thereto. Therefore, in case a jam occurs in the duplex unit 28, both outer covers 28*a* and 28*b* are opened in a predetermined direction to remove the jammed paper therefrom. As should be readily recognized, in the embodiment shown in the figure, it is easy for the operator to open the cover due to the arrangement which enables opening thereof at the front position of the body casing 1. Furthermore, if all the parts of the cover including the parts behind the operating panel 14 are designed to be opened as shown in FIG. 7**, it is easier for the operator to remove the jammed paper.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A printer system comprising:

a printer having a printer body;

an operation panel composed of a key switch and a display;

a duplex unit for feeding a copy paper having an image on one side thereof toward an inlet of the printer body;

wherein said operation panel is disposed on a front side of said printer body and said operation panel is slidable with respect to said printer body between an extended position and a retracted position, and wherein at least in said extended position a space is provided between said operation panel and said printer body, said space extending in a direction of sliding movement of said operation panel, and said duplex unit is disposed in said space between said printer body and said operation panel.

2. A printer system as claimed in claim 1, further comprising:

a copy paper cassette accommodating a copy paper therein;

a feeding means for feeding a copy paper from said cassette;

a feeding inlet, through which said copy paper is fed into said printer from said cassette;

wherein an outlet for paper ejecting from said duplex unit is formed above said feeding inlet.

3. A printer system as claimed in claim 1, further comprising:

a feeding tray for accommodating a copy paper therein with said feeding tray swingable from a horizontal position, in which said paper is fed, to vertical position; and said duplex unit is set in an area between said feeding tray in said vertical position and said printer body casing.

4. A printer system as claimed in claim 3, further comprising:

a first connecting member disposed on said feeding tray;

a second connecting member disposed on said printer body;

a third connecting member disposed on said duplex unit;

wherein said first connecting member connects with one of said second connecting member and said third connecting member when said feeding tray is in said vertical position.

5. A printer system as claimed in claim 4, wherein said first connecting member is made of a magnet and said second and third connecting members are made of metal.

6. A printer system comprising:

a printer having a printer body;

a duplex unit for feeding a copy paper having an image on one side thereof toward an inlet of the printer body, said duplex unit including a first substantially rectangular portion and a second substantially rectangular portion, each of said first and second substantially rectangular portions having a pivotally mounted cover;

wherein said duplex unit is detachably mounted at an upper corner of said printer body such that said first substantially rectangular portion extends along a top of said printer body and said second substantially rectangular portion extends along a side of said printer body.

7. A printer system as claimed in claim 6, wherein said duplex unit includes a corner portion at which said first substantially rectangular portion meets said second substantially rectangular portion, and wherein the cover of the first substantially rectangular portion is mounted upon a first pivot means and the cover of said first substantially rectangular portion extends from said first pivot means in a direction toward said corner portion, and further wherein the cover of the second substantially rectangular portion is mounted upon a second pivot means and extends from said second pivot means in a direction toward said corner portion.

8. A printer system as claimed in claim 7, wherein said corner portion of said duplex unit includes a recess, the printer system further comprising an operating panel connected to said printer body and extending into said recess.

9. A printer system as claimed in claim 8, wherein said operating panel is slidably mounted upon said printer body.

10. A printing apparatus comprising:

a printer body;

an operating panel slidably mounted on said printer body such that said operating panel is movable between a first position which is adjacent to said printer body and a second position spaced from said printer body; and a duplex unit detachably mounted on said printer body, said duplex unit including a portion disposed between said operating panel and said printer body when said operating panel is in said second position.

11. The printing apparatus of claim 10, wherein said operating panel is connected to a bracket member which is slidably received in an aperture of said printer body.

12. The printing apparatus of claim 11, further including a connector disposed on said bracket such that said connector is outside said printer body when said operating panel is in said second position and said connector is inside said printer body when said operating panel is in said first position.

13. The printing apparatus of claim 12, wherein said duplex unit is L-shaped.

14. The printing apparatus of claim 12, wherein said duplex unit includes a duplex unit connector which mates with the connector of said bracket to thereby electrically connect said duplex unit to said printer.

15. The printing apparatus of claim 10, wherein said portion of said duplex unit between said operating panel and said printer body includes a recess which receives said operating panel.

16. The printing apparatus of claim 15, wherein said printer body includes a recessed portion which receives said operating panel when said operating panel is in said first position.

17. The printing apparatus of claim 10, wherein said duplex unit includes first and second legs connected at a corner such that said duplex unit has an L-shape, and wherein a portion of said corner is notched to receive said operating panel.

18. The printing apparatus of claim 17, wherein each of said first and second legs includes a pivotally mounted panel.

19. The printing apparatus of claim 17, wherein said operating panel is mounted upon a bracket having an electrical connector thereon which mates with an electrical connector of said duplex unit.

* * * * *